US007200962B2

(12) United States Patent
Carter

(10) Patent No.: US 7,200,962 B2
(45) Date of Patent: Apr. 10, 2007

(54) FLEXIBLE, FRAMELESS DISPLAY MODULE, DEVICE AND METHOD

(75) Inventor: William Carter, Dyer, IN (US)

(73) Assignee: Keyser Industries, Inc., Evergreen Park, IL (US)

( * ) Notice: Subject to any disclaimer, the term of this patent is extended or adjusted under 35 U.S.C. 154(b) by 131 days.

(21) Appl. No.: 10/801,323

(22) Filed: Mar. 16, 2004

(65) Prior Publication Data

US 2005/0204597 A1 Sep. 22, 2005

(51) Int. Cl.
*G09F 23/00* (2006.01)

(52) U.S. Cl. ..... 40/568; 40/575; 40/576; 40/611.08

(58) Field of Classification Search ..... 40/568, 40/575, 576, 611.08, 618, 490
See application file for complete search history.

(56) References Cited

U.S. PATENT DOCUMENTS

| | | | | | |
|---|---|---|---|---|---|
| 1,258,146 | A | | 5/1918 | Russell | |
| 1,831,228 | A | | 11/1931 | Clark | |
| 1,841,026 | A | | 1/1932 | Greenstone | |
| 1,887,591 | A | * | 11/1932 | Fugita | 40/618 |
| 2,057,064 | A | | 10/1936 | Shively et al. | |
| 2,079,230 | A | | 5/1937 | Shively | |
| 2,308,556 | A | * | 1/1943 | Walker | 40/618 |
| 2,319,910 | A | | 5/1943 | Adler | |
| 2,561,813 | A | | 7/1951 | Murphy | |
| 2,976,634 | A | | 3/1961 | Ashley | |
| 3,013,475 | A | | 12/1961 | Spangler | |
| 3,531,884 | A | * | 10/1970 | Adler | 40/618 |
| 3,673,720 | A | | 7/1972 | Thornton | |
| 3,685,186 | A | | 8/1972 | Goodman | |
| 3,905,139 | A | | 9/1975 | Cooper | |
| 3,939,584 | A | | 2/1976 | Trame | |
| 4,111,307 | A | | 9/1978 | Peggs | |
| 4,138,787 | A | * | 2/1979 | Sarkisian et al. | 40/618 |
| 4,171,584 | A | * | 10/1979 | Kaiser | 40/490 |
| 4,345,396 | A | | 8/1982 | Janssen | |
| 4,364,616 | A | | 12/1982 | Harkins et al. | |
| 4,367,604 | A | | 1/1983 | Porter, II et al. | |
| 4,461,107 | A | | 7/1984 | Grate | |
| 4,521,984 | A | * | 6/1985 | Murray | 40/576 |
| 4,553,345 | A | * | 11/1985 | Bercier et al. | 40/576 |
| 4,593,486 | A | | 6/1986 | Visocky et al. | |
| 4,606,141 | A | | 8/1986 | Murray | |

(Continued)

FOREIGN PATENT DOCUMENTS

| | | |
|---|---|---|
| WO | WO 90/07173 | 6/1990 |

(Continued)

*Primary Examiner*—Gary C. Hoge
(74) *Attorney, Agent, or Firm*—Ryndak & Suri LLP

(57) ABSTRACT

A display module for an illuminated display device is provided having a flexible, non-self-supporting, at least substantially translucent sheet and a plurality of spaced apart, horizontally disposed divider members positioned on one side of the sheet. Each of the divider members may include a retaining structure for retaining portions of display members in a predetermined position. A plurality of display members having translucent portions are positioned between spaced apart sets of divider members. An illuminated display device is also provided which includes a housing having an opening, at least one lighting source inside the housing for projecting light through the opening, and a display module. A method of assembling a display module in accordance with the invention is further provided.

34 Claims, 2 Drawing Sheets

U.S. PATENT DOCUMENTS

| | | | | | |
|---|---|---|---|---|---|
| 4,653,209 | A | * | 3/1987 | Cobb | 40/618 |
| 4,682,430 | A | | 7/1987 | Ramsay | |
| 4,693,026 | A | * | 9/1987 | Callahan et al. | 40/576 |
| 4,753,026 | A | | 6/1988 | Woodman et al. | |
| 4,817,316 | A | * | 4/1989 | Walker | 40/576 |
| 4,827,644 | A | | 5/1989 | Trame | |
| 4,977,698 | A | | 12/1990 | Seggerson | |
| 5,065,537 | A | * | 11/1991 | Bailey | 40/618 |
| 5,255,459 | A | | 10/1993 | Verret | |
| 5,379,540 | A | | 1/1995 | Howard | |
| 5,636,463 | A | | 6/1997 | Sharon et al. | |
| 5,682,694 | A | | 11/1997 | Hillstrom | |
| 5,901,486 | A | | 5/1999 | Sharon et al. | |
| 5,983,543 | A | | 11/1999 | Hillstrom | |
| 6,125,565 | A | | 10/2000 | Hillstrom | |
| 6,182,387 | B1 | | 2/2001 | Duguay | |
| 6,298,589 | B1 | | 10/2001 | Hillstrom | |
| 6,631,576 | B2 | | 10/2003 | Hillstrom | |

FOREIGN PATENT DOCUMENTS

| | | |
|---|---|---|
| WO | WO 92/03814 | 3/1992 |
| WO | WO 97/20299 | 6/1997 |

* cited by examiner

FIG, 7B

FLEXIBLE, FRAMELESS DISPLAY MODULE, DEVICE AND METHOD

FIELD OF THE INVENTION

This invention relates to a flexible, frameless, non-self-supporting display module, and an illuminated display device incorporating one or more of the modules. Such devices are particularly suitable for indoor or outdoor use, such as at restaurants, for example.

BACKGROUND OF THE INVENTION

Various display boards are known in the art, such as illuminated menu display boards, which are commonly utilized at fast-food restaurants, for example, to display food items, associated pricing, advertised specials, and other information. These menu display boards are commonly used in outdoor locations at "drive through" windows and behind and above typical restaurant counters. Changes to the displayed information frequently need to be made due to customer demand, menu changes, pricing changes, or for other reasons. Thus, there is a need for a display board wherein the displayed information is easily changed and yet is of simple construction. A need also exists for a display device that can be rapidly changed from breakfast items, for example, to lunch and dinner items.

SUMMARY OF THE INVENTION

In accordance with the present invention, a flexible, self-supporting frameless display module is provided which is adapted to be disposed within an illuminated display device and is particularly suited for displaying menu information.

In accordance with one aspect of the present invention, the display module includes a flexible, non-self-supporting, at least substantially translucent sheet and a plurality of spaced apart horizontally disposed divider members positioned on one side of the sheet in fixed relation for retaining display members adjacent the sheet. Preferably, the flexible sheet is transparent. In one embodiment, each of the divider members are retained on one side of the sheet by a male connection member on each divider member which engages one of a plurality of corresponding female connection members on the sheet, such as apertures. In another embodiment, each of the divider members are held in place over the sheet by a corresponding one of a plurality of retention members which are secured over the sheet in fixed relation on a side of the sheet opposite the side on which the divider members are located.

In accordance with another aspect of the present invention, the display module includes a flexible, non-self-supporting, at least substantially translucent sheet and a plurality of spaced apart horizontally disposed divider members positioned on one side of the sheet in fixed relation for retaining display members adjacent the sheet. The divider members not only divide the sheet into a plurality of horizontal regions, but may also include a retaining structure for retaining portions of display members bearing food descriptions, pricing information, restaurant or company information, artwork, or any other desired information in a predetermined position. Each of the divider members are held in place over the sheet by a corresponding one of a plurality of retention members which are secured over the sheet in fixed relation on a side of the sheet opposite the side on which the divider members are located. By "secured over" it is meant that the retention members may be directly secured to the sheet, indirectly secured to the sheet by an intermediate member, or integrally formed as part of the sheet.

A plurality of display members may be positioned in between spaced apart sets of divider members which are held in place by the retention members. The display members each have a translucent portion to allow light from the lighting source of the illuminated display device to shine through the display members to make the translucent portions even more visible to a consumer, for example, particularly after dark. Additionally, the display members are preferably flexible, and are preferably plastic, such that the display member may be flexed if desired in order to be inserted between two adjacent divider members. However, the display members may be of any other suitable material, typically having a translucent portion. The display members typically contain human readable information, such as menu information, for example. Any desired type of information may be present on display members.

In one embodiment, divider members are individually removable from the sheet. In another embodiment, individual ones of the divider members and display members can be removed and replaced relative to opposed retention members.

In accordance with another aspect of the present invention, the divider members include a retaining structure to retain a display member between adjacent opposed pairs of divider members. In one embodiment, the retaining structure is a longitudinally extending rib which extends substantially along the length of the divider member. When the divider members are held in a fixed position by the retention members, the display member may be maintained in a relatively horizontal position by opposed or adjacent pairs of longitudinally extending ribs on opposed or adjacent divider members.

In accordance with yet another aspect of the present invention, the divider members include opposed pairs of longitudinally extending channels wherein a display member may be retained within an opposed pair of longitudinally extending channels on two adjacent divider members when the divider members are held in a fixed position by the retention members.

In accordance with another aspect of the present invention, the divider members may be held in place by mating male and female connection members associated with the divider members and retention members respectively. By "associated" it is meant that the male connection members and female connection members are either included on, or associated with or are carried on the divider members and retention members respectively. It is contemplated that this arrangement may be reversed, with the divider members having female portions and the retention members having male portions if desired.

The mating male and female connection members not only enable the cooperation of divider members and retention members, but also provide a retaining structure for a display member disposed between any two adjacent divider members. Preferably, the male connection members extend through a corresponding aperture located in the sheet and extend from one side of the sheet to the other side of the sheet wherein the male connection members are retained by female connection members. Alternatively, the divider and retention members may extend beyond the sides of the flexible sheet and so that no holes extend through the sheet. Additionally, the divider members preferably include a longitudinally spaced rib on each of the divider members.

In one embodiment, each of the retention members includes a plurality of spaced apart apertures, each of which define a female connection member which is adapted to be engageable with one of a corresponding opposed plurality of male connection members associated with a divider member. The retention members are located on the side of the sheet opposite the side on which the divider members are located. The male connection members engage the apertures of a corresponding one of a plurality of retention members. A display member may be retained between any two adjacently cooperated display members. Preferably, the divider members further include a longitudinally spaced rib on each of the divider members to aid in the retention of a member between two adjacent divider members.

In accordance with one aspect of the present invention, an illuminated display device is provided which includes a housing having an opening, at least one lighting source positioned inside the housing for projecting light through the opening, and at least one display module, as previously described herein, removably disposed within the opening in the housing.

In accordance with another aspect of the present invention, a method of assembling a display module is provided. The method comprising securing together a plurality of opposed pairs of retention members and divider members and on opposite sides of a flexible non-self-supporting at least substantially translucent sheet in fixed relation and horizontally arrayed, and positioning in a retaining relationship a plurality of display members between opposed or adjacent sets of divider members, the display members having translucent portions.

Other advantages and features of the invention will become apparent from the following description and from reference to the drawings.

BRIEF DESCRIPTION OF THE DRAWINGS

FIG. 7B is a fragmentary side view of the cooperation between the male connection member cooperated with the female connection member of FIG. 7A.

DETAILED DESCRIPTION

Figure 1:
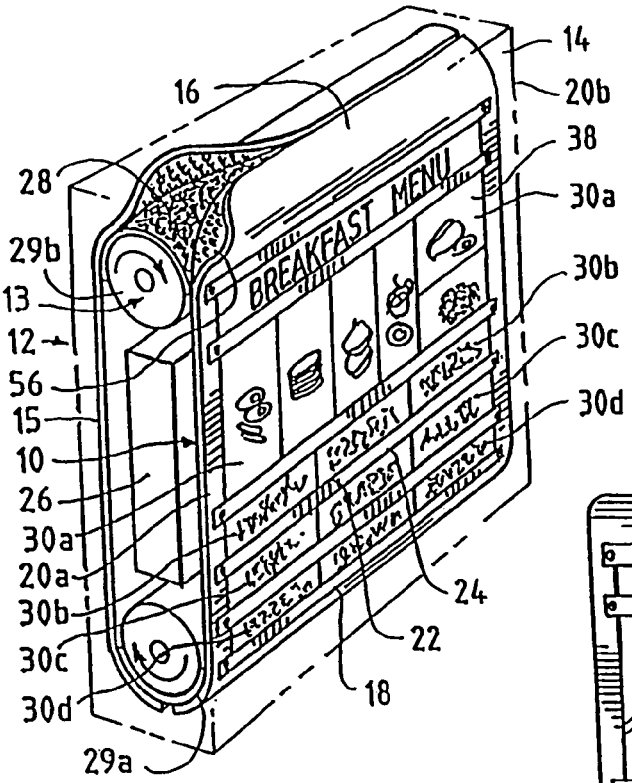
FIG. 1 is a front perspective view illustrating an illuminated display device in accordance with the present invention.

While this invention is susceptible of embodiment in many different forms, there is shown in the drawings and described in detail herein, several specific embodiments with the understanding that the present disclosure is to be considered as exemplifications of the principles of the invention and is not intended to limit the invention to the embodiments illustrated.

Referring to the figures generally and in particular to FIG. 1, a display module 10 according to the present invention is shown generally as being disposed within an illuminated display device 12. Illuminated display device 12 includes a housing 14 having a top portion 16, bottom portion 18, and side edges 20*a*, 20*b*. Housing 14 also includes an opening 22 in a front portion 24 of illuminated display device 12. Optionally, illuminated display device 12 may include a transparent or substantially translucent door (not shown) which may be connected to the housing by any suitable manner, such as by a suitable hinge or hinges.

Housing 14 further typically includes lighting source 26 spaced behind display module 10 to backlight display module 10 when display module 10 is disposed within housing 14. Lighting source 26 preferably includes fluorescent light tubes of a suitable length and wattage, but alternatively any other suitable lighting source can be utilized as would be recognized by one skilled in the art.

Housing 14 may be used either indoors or outdoors and thus may be formed from a relatively rigid and relatively weatherproof material, such as metal, and preferably aluminum, to protect the housing and door from the deleterious effects of sun, wind, rain, snow, freezing temperatures, and elevated temperatures, particularly when illuminated display device 12 is placed in an outdoor environment. If illuminated display device 12 includes a door, the door may also be of a relatively weatherproof material, preferably glass, but may be any other suitable transparent or substantially translucent material which is relatively weatherproof. Additionally, for outdoor use, such as "drive through" of a restaurant, housing 14 may be secured to a suitable base (not shown) mounted in the ground or a suitable supporting surface to add height and to provide stability to housing 14. Housing 14 may further be provided with suitable venting for the interior when display module 10 is disposed within the opening of a housing having a door.

In accordance with one aspect of the present invention, display module 10 is adapted to be connected to a portion of illuminated display device 12 when display module 10 has been assembled as desired. In one embodiment, as shown in FIG. 1, illuminated display device 12 includes at least one elongated strip of hook and loop fasteners 28, and preferably at least two elongated strips of hook and loop fasteners, which cooperate with a corresponding strip of hook and loop fasteners on display module 10 as will be discussed further in detail below.

Alternatively, any other suitable material or fasteners may be used for connecting display module 10 to front portion 24 of illuminated display device 12, including but not limited to, rivets, nuts and bolts, screws, or other threaded fasteners, clips, welds, and adhesives, for example.

Illuminated display device 12 may further include a rotating mechanism 13 which selectively changes the divider members which are visible in opening 22 of housing 14 of illuminated display device 12. In one embodiment, as shown in FIG. 1, rotating mechanism 13 includes two rotating members 29*a*, 29*b* which may move display members 30*a*–30*d* of display module 10 along a predetermined pathway defined by a belt 15 that moves as mechanism 13 operates. Preferably, display module 10 includes at least two display modules 10, for example, one for breakfast and a group for lunch, which can travel via rotating members 29*a*, 29*b* with belt 15 along its pathway. Belt 15 can be a flexible, transparent or translucent belt having loop (or hook) fastener material 28 in desired areas to permit the attachment of module(s) 10 thereto, which has hook (or loop) fastener material 56 on desired areas. Such hook and loop fastener material may be Velcro®.

Figure 2:
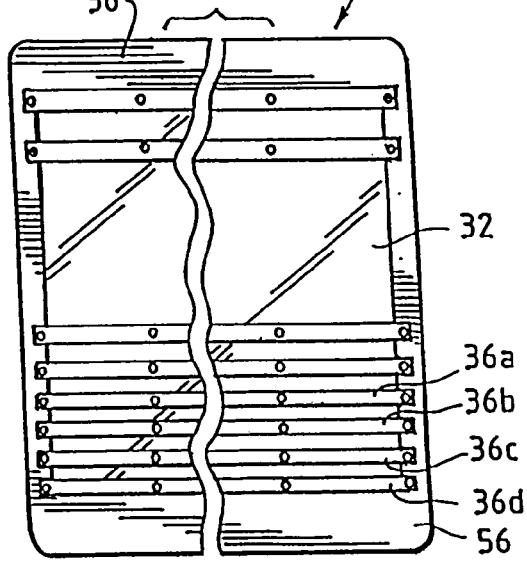
FIG. 2 is a front elevation view of a display module in accordance with the present invention.
Figure 3:
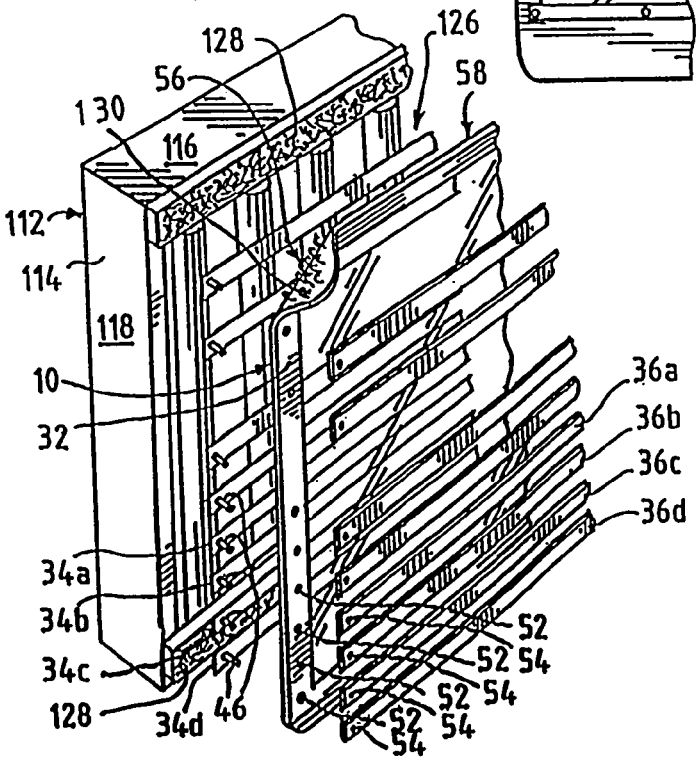
FIG. 3 is a front perspective fragmentary exploded view illustrating the cooperation of a divider member and a retention member within an illuminated display device in accordance with the present invention.

Display module 10 includes a flexible, non-self-supporting, at least substantially translucent sheet 32, a plurality of divider members 34*a*–34*d*, and a plurality of retention members 36*a*–36*d*, and a plurality of display members 30*a*–30*d*, as shown in FIGS. 1–3.

Sheet 32 has a front side 38 and a rear side 40 and is of a flexible material, such as plastic or any other suitable at least substantially translucent material. It is contemplated that sheet 32 may be transparent, but should be at least substantially translucent so that light may pass through sheet 32 when display module 10 is disposed within opening 22 of housing 14. By "non-self-supporting," it is meant that the sheet is not self-supporting by itself (typically because it is too flexible or not sufficiently rigid).

As illustrated, divider members 34*a*–*d* are horizontally disposed on a side of sheet 32, for example, on rear side 40 as shown, in fixed relation to sheet 32 for retaining display members 30*a*–*d*, as shown in FIG. 1. Divider members 34*a*–*d* thus divide front side 38 into a plurality of relatively horizontal regions wherein display members 30*a*–*d* may be retained between adjacent divider members in the relatively horizontal regions to display information, such as food descriptions, pricing information, restaurant or company information, artwork, or other desired information. Divider members 34*a*–*d* are preferably elongated strips of extruded plastic or extruded metal. Alternatively, any other suitable material may be used.

Divider members 34*a*–*d* are held in place on one side of sheet 32, preferably on rear side 40, by a corresponding one of a plurality of retention members 36*a*–*d*, preferably on front side 38, as shown in FIGS. 3–6. Retention members 36*a*–*d* are secured over sheet 32 in fixed relation to sheet 32 on a side opposite the side on which divider members 34*a*–*d* are located. By "secured over" it is meant that the retention members may be directly secured to the sheet, indirectly secured to the sheet by an intermediate member, or integrally formed as part of the sheet. Retention members 36*a*–*d* are indirectly secured to sheet 32 when any one of retention members 36*a*–*d* is cooperated with a respective one of divider members 34*a*–*d* as will be discussed in detail further below. Sheet 32 is disposed between divider members 34*a*–*d* and retention members 36*a*–*d*, and retention members 36*a*–*d* are preferably located on front side 38 when divider members 34*a*–*d* are preferably located on rear side 40. Preferably, retention members 36*a*–*d* are carried on, associated with or included on elongated strips of extruded plastic or metal. Alternatively, any other suitable material may be used.

Additionally, the retention members may be directly secured to the sheet by suitable fasteners such as rivets, screws, adhesive, or by any other securement material or member. Further, the retention members may be extruded along with the sheet and thus be integral with sheet, preferably from plastic.

Display members 30*a*–*d* may be positioned in between spaced apart sets of divider members 34*a*–*d* which are held in place by retention members 36*a*–*d*, as shown in FIG. 1. Display members 30*a*–*d* each have a translucent portion to allow light from the lighting source of the illuminated display device 12 to shine through display members 30*a*–*d* to render the translucent portions even more visible to a consumer, for example, particularly after dark. Each of display members 30*a*–*d* may have indicia, typically human-readable indicia, on at least one side thereof bearing food descriptions, pricing information, restaurant or company information, artwork, or any other desired information. Additionally, display members 30*a*–*d* are preferably elongated flexible plastic strips, but may be any other suitable material or shape. Preferably, individual display members 30*a*–*d* are removable from the display module 10, and also preferably, individual ones of divider members 34*a*–*d* and display members 30*a*–*d* are removable from display module 10.

Figure 4:
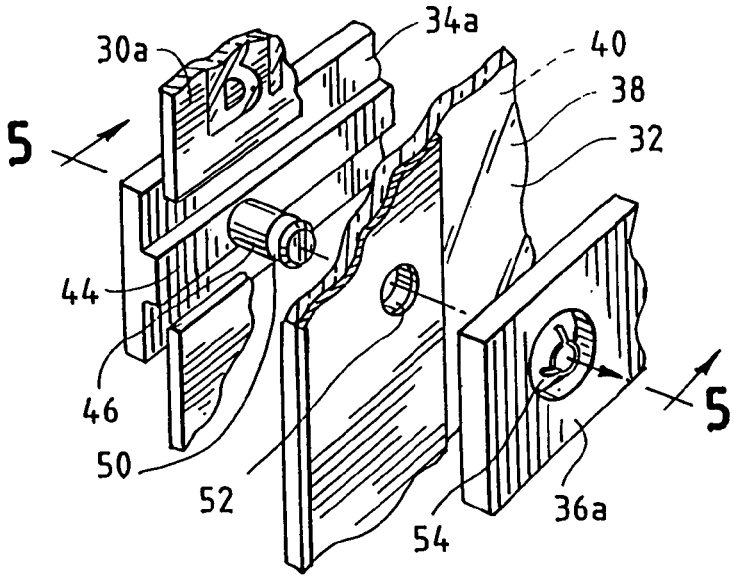
FIG. 4 is a front perspective fragmentary exploded view illustrating the cooperation of a divider member and a retention member through the sheet in a display module in accordance with the present invention.

Each divider member 34*a*–*d* typically includes a retaining structure to retain a portion of one of display members 30*a*–*d*. An individual one of display members 30*a*–*d* is retained between adjacent pairs of divider members 34*a*–*d* having the retaining structures. In one embodiment, as shown in FIG. 4, the retaining structure is a longitudinally extending rib 44 which extends longitudinally along at least a portion of the entire length of divider member 34*a*, and preferably extends longitudinally along the entire length of divider member 34*a*. When divider members 34*a*–*d* are held in a fixed position by retention members 36*a*–*d*, display members 30*a*–*d* may be maintained in a relatively fixed horizontal position by opposed pairs of longitudinally extending ribs 44 on opposed pairs of divider members 34*a*–*d*, for example.

In accordance with another embodiment of the present invention, divider members 34*a*–*d* may include an opposed pair of longitudinally extending channels (not shown) within a top edge or bottom edge of the divider member for retaining the display member. Preferably, the channels extend longitudinally along at least a portion of the entire length of the divider member, and preferably the longitudinally extending channels extend longitudinally along the entire length of the divider member. When divider members 34*a*–*d* are held in a fixed position by retention members 36*a*–*d*, a display member may be maintained in a relatively fixed horizontal position by any pair of opposed longitudinally extending channels.

Another embodiment of the invention is shown in FIG. 3. Display module 10 is incorporated into an illuminated display device 112 that includes a housing 114, a top portion 116, and side 118 (only the left side 118 is illustrated), light source 126 and Velcro® loop fastening members 128 and optionally a door (not shown). Display module 10 can be conveniently secured within housing 114 by attaching hook fasteners 130 of display module 10 to loop fasteners 128 of housing 114. Obviously, the location of hook and loop fasteners 130 and 128 can be reversed, if desired.

In one embodiment, each of divider members 34*a*–*d* is held in a fixed horizontal position relative to the sheet by mating male connection members 46 and female connection members, for example as in apertures 54, associated with the divider members 34*a*–*d* and retention members 36*a*–*d* respectively. By "associated" it is meant that male connection members 46 and female connection members are either included on, are carried on or are otherwise secured to, divider members 34*a*–*d* and retention members 36*a*–*d* respectively. Thus, it is contemplated that male connection members 46 may be integrally formed with divider members 34*a*–*d* and the female retention members, as in apertures 54, may be integrally formed with retention members 36*a*–*d*, preferably from extruded plastic or metal.

Figure 5:
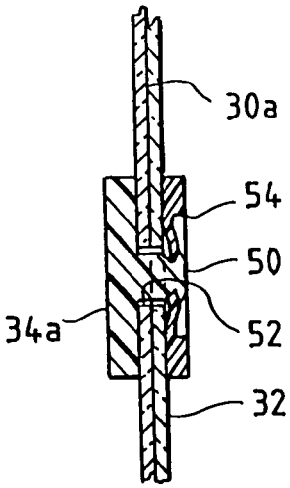
FIG. 5 is a fragmentary side elevation view along line 5—5 of FIG. 4.
Figure 6:
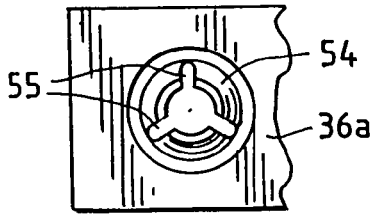
FIG. 6 is an enlarged, fragmentary front elevation view of a female connection member in accordance with the present invention.

Preferably, each of male connection members 46 extend through corresponding sheet apertures 52 located in sheet 32 and extend from one side of sheet 32 to the other side of sheet 32, and preferably from rear side 40 to front side 38 of sheet 32. Further, as shown in FIG. 4, each male connection member 46 preferably includes a groove 50 to aid in securing each male connection member to a corresponding female connection member, as in for example, aperture 54. The female connection members are preferably four spaced apart apertures 54, as shown in FIGS. 4–6. Alternatively, the female retention members may include any female member which will accept any one of male connection members 46. One of display members, such as display member 30*a* may then be held in place by cooperation of male connection member 46 with aperture 54 of retention member 36*a*, as shown in FIGS. 4–5, which includes a plurality of radially outwardly extending slots 55 which permit the expansion of aperture 54 during insertion of male connection member 46 followed by a subsequent retraction of aperture 54 over member 46.

Figure 7A:
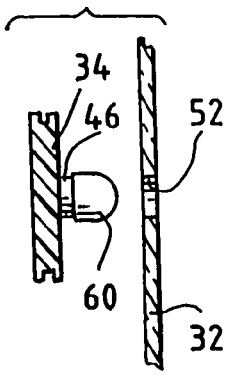
FIG. 7A is a fragmentary side view of a divider member having a male connection member and a sheet having a female connection member in accordance with the present invention.
Figure 7A:
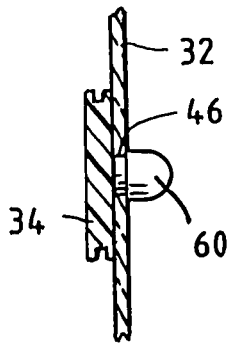

In another embodiment, where display module 10 preferably is not subjected to a great deal of movement or stress, each divider member 34*a*–*d* may not require a corresponding retention member 36*a*–*d* to be retained in fixed relation to sheet 32. Thus, for example, divider member 34*a* in FIG. 4 could be secured to sheet 32 without the aid of retention member 36*a*. Instead, each divider member 34*a*–*d* has a male connection member 46 which cooperates with one of a plurality of corresponding female connection members on sheet 32, preferably as in aperture 52, for example, as shown in FIG. 7A. Additionally, each male connection member 46 preferably has a retaining structure such as a bulb 60, flange, barb, lip, slit, groove, or other suitable structure which cooperates with the aperture 52 when at least a portion of male connection member 46 is inserted through aperture 52 of sheet 32, as shown in FIG. 7B. Aperture 52 may include a plurality of radially outwardly extending slots (not shown) which permit the expansion of the aperture during insertion of male connection member 46 followed by a subsequent retraction of aperture 52 over member 46. When the male connection member 46 is inserted through aperture 52, each divider member 34 is maintained in fixed relation to sheet 32.

Male connection members 46 not only enable divider members 34*a*–*d* to be cooperated with retention members 36*a*–*d*, but male connection members 46 also provide a retaining structure for retaining a portion of any one of display members 30*a*–*d*. In particular, a single one of display members 30*a*–*d* may be retained between any two divider members 34*a*–*d* having male connection members 46. It is contemplated that divider members 34*a*–*d* may include four or more male connection members 46 and any of retention members 36*a*–*d* may include a corresponding four or more female connection members to fully support display members 30*a*–*d* between two adjacent pairs of divider members 34*a*–*d*. Divider members 34*a*–*d* may further include a longitudinally extending channel or longitudinally extending rib 44, as shown in FIG. 4 and as described herein, to retain a display member 30 in between any two adjacent divider members. Each male connection member 46 preferably extends from longitudinal extending rib 44, as is also shown in FIG. 4.

In accordance with another aspect of the present invention, sheet 32 includes hook fasteners 56, on at least a top portion 58 of sheet 32, as shown in FIG. 3, which is adapted to be mated with to corresponding portions of loop fasteners 128 on housing 14 such that display module 10 can be further retained to housing 14.

In operation, flexible, non-self-supporting frameless display module 10 is assembled as follows from its components. As shown in FIG. 3 and more closely in FIG. 4, preferably, divider member 34*a* is pushed flush against rear side 40 of sheet 32. If divider member 34*a* includes a male connection member 46*a*, male connection member 46*a* is pushed through corresponding aperture 52 in sheet 32 such that male connection member 46*a* extends from one side of sheet 32 to the other side of sheet 32. The female connection member, aperture 54, of retention member 36*a* can then be placed over male connection member 46*a* and secured, as shown in FIGS. 4–5.

Subsequently, display member 30*a* may be placed on a top portion of extending longitudinal rib 44 if divider member 34*a* has rib 44, as in FIG. 4. If the divider member has a longitudinally extending channel (not shown), the display member may be placed substantially within the channel. It is contemplated that display member 30*a* may be pushed flush against rear side 40 of sheet 32 collectively with a first divider member 34*a* when first divider member 34*a* is assembled, and subsequently secured to sheet 32 with a second divider member 34*b* which is assembled as described above.

After a first display member 30*a* is associated with at least one divider member 34*a*, a second opposed display member 30*b* may be assembled as described above and as shown in FIGS. 3–5, for example, vertically above or below the first assembled divider member to fully secure display member 30*b* in place. Further, the above method may be repeated for as many display members as are desired to be displayed. It is contemplated that not all available retention members and divider members need be used to incorporate larger display members in the display module.

If a display member is desired to be changed, any one of display members 30*a*–*d* may easily be removed and replaced by simply pulling any one of retention members 36*a*–*d* in a direction away from sheet 32. If the retention members are directly secured to sheet 32 or are integral with the sheet 32, the display member may be pulled in a direction away from sheet 32 to access the display member.

The assembled display module may be inserted into opening 22 of housing 14 of illuminated display device 12, as shown in FIG. 1. For example, in the embodiment where display module 10 includes a hook fastener portion 56 and housing 14 includes a mating loop fastener portion 28 (or 128 in FIG. 3), the corresponding portions may be mated with one another. Such material may be Velcro®, for example. After fastening, illuminated display device 12 is fully assembled and lighting source 26 may be powered to yield a menu display device where the displayed information is illuminated.

While the invention has been described with respect to certain preferred embodiments, it is to be understood that the invention is capable of numerous changes, modifications, and rearrangements without departing from the scope or spirit of the invention as defined in the claims.

What is claimed is:

1. A display module for an illuminated display device, the display module comprising:

a flexible, non-self-supporting, at least substantially translucent sheet;

a plurality of spaced apart, horizontally disposed divider members positioned on one side of said sheet;

a retaining structure on each of said divider members for retaining portions of display members in a predetermined position;

each of said divider members held in place over said sheet by a corresponding one of a plurality of retention members, secured over said sheet in fixed relation on a side of said sheet opposite to the side on which said divider members are located; and a plurality of display members positioned between spaced apart sets of said divider members, said display members having translucent portions.

2. The display module of claim 1 wherein said divider members are individually removable.

3. The display module of claim 1 wherein said flexible non-self-supporting sheet is transparent.

4. The display module of claim 1 wherein said retaining structure on each of said divider members comprises a longitudinally extending rib on each of said divider members.

5. The display module of claim 1 wherein said divider members being held in place by mating male and female connection members associated with said divider members and said retention members.

6. The display module of claim 1 wherein individual ones of said divider members and said display members can be removed and replaced in said opposed retention members.

7. The display module of claim 1 wherein said display members are flexible.

8. The display module of claim 4 wherein each of said retention members has a plurality of spaced-apart apertures each defining a female connection member adapted to be engageable with one of a corresponding opposed plurality of male connection members carried by said divider members, said corresponding one of a male connection member opposed to said female connection member on said retention member and located on the opposite side of said flexible non-self-supporting sheet from the side on which said retention member is located.

9. The display module of claim 1 wherein each of said divider members defines, with an opposed portion of said sheet, an opposed pair of longitudinally extending channels in each of said divider members.

10. The display module of claim 5 wherein each of the male connection members extend through a corresponding aperture located in said sheet, and extend from one side of the sheet to the other side of the sheet.

11. The display module of claim 1 wherein each said retention member is secured to said sheet by cooperation of said retention member and a respective one of said divider members, with the sheet located between said retention members and said divider members.

12. A display module for an illuminated display device, the display module comprising:

a flexible, non-self-supporting, at least substantially translucent sheet;

a plurality of spaced apart horizontally disposed divider members positioned on one side of said sheet in fixed relation for retaining display members adjacent the sheet.

13. The display module of claim 12 further comprising a plurality of opposed, horizontally disposed retention members positioned on the side of said sheet opposite the side on which said divider members are located and each of said retention members cooperating with said divider members to hold in place the respective ones of said divider members and retention members.

14. The display module of claim 13 further comprising a pair of opposed longitudinally extending channels in each of said divider members formed by cooperation of said divider members and said sheet for securing portions of display members.

15. The display module of claim 14 further comprising a plurality of display members positioned between opposed sets of said channels, said display members having translucent portions.

16. The display module of claim 15 wherein said divider members and said display members can be removed and replaced in said opposed relation to said retention members.

17. The display module of claim 12 wherein said divider members are individually removable.

18. The display module of claim 12 wherein said sheet is transparent.

19. The display module of claim 13 wherein said divider members are held in place by mating male and female connection members associated with said divider members and said retention members.

20. The display module of claim 19 wherein individual ones of said divider members and said display members can be removed and replaced in said opposed retention members.

21. The display module of claim 19 wherein each of the male connection members extend through a corresponding aperture located in said sheet, and extend from one side of the sheet to the other side of the sheet.

22. The display module of claim 13 wherein each said retention member is secured to said sheet by cooperation of said retention member and a respective one of said divider members, with the sheet located between said retention members and said divider members.

23. An illuminated display device comprising:

a housing having an opening;

at least one lighting source positioned inside the housing for projecting light through the opening;

at least one display module removably disposed within the opening in the housing, the display module comprising:

a flexible, non-self-supporting, at least substantially translucent sheet; a plurality of spaced apart horizontally disposed divider members positioned on one side of said sheet in fixed relation for retaining display members adjacent the sheet.

24. The display device of claim 23 further comprising a plurality of opposed, horizontally disposed retention members positioned on the side of said sheet opposite the side on which said divider members are located and each of said retention members cooperating with said divider members to hold in place the respective ones of said divider members and retention members.

25. The display device of claim 24 further comprising a pair of opposed longitudinally extending channels in each of said divider members formed by cooperation of said divider members and said sheet for securing portions of display members.

26. The display device of claim 25 further comprising a plurality of display members positioned between opposed sets of said channels, said display members having translucent portions.

27. The display device of claim 26 wherein said divider members and said display members can be removed and replaced in said opposed retention members.

28. The display device of claim 24 wherein said divider members are held in place by mating male and female connection members associated with said divider members and said retention members.

29. The display device of claim 28 wherein said sheet is transparent.

30. The display device of claim 28 wherein individual ones of said divider members and said display members can be removed and replaced in said opposed retention members.

31. The display device of claim 30 wherein each of the male connection members extends through a corresponding aperture located in said sheet, and extends from one side of the sheet to the other side of the sheet.

32. The display device of claim 31 wherein the sheet can be folded into two substantially parallel portions within the display device.

33. A method of assembling a display module comprising:

securing together a plurality of opposed pairs of retention members and divider members and on opposite sides of a flexible non-self-supporting at least substantially translucent sheet in fixed relation and horizontally arrayed;

positioning in a retaining relationship a plurality of display members between opposed sets of divider members, said display members having translucent portions.

34. The method of claim 33 wherein said positioning comprises positioning portions of said display members in longitudinally extending channels located between said divider members and opposed portions of said flexible sheet.

* * * * *